US012084739B2

(12) United States Patent
Murakami et al.

(10) Patent No.: US 12,084,739 B2
(45) Date of Patent: Sep. 10, 2024

(54) STEEL SHEET

(71) Applicant: Kobe Steel, Ltd., Kobe (JP)

(72) Inventors: Toshio Murakami, Kobe (JP); Keita Nakayama, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 567 days.

(21) Appl. No.: 17/424,050

(22) PCT Filed: Feb. 12, 2020

(86) PCT No.: PCT/JP2020/005370
§ 371 (c)(1),
(2) Date: Jul. 19, 2021

(87) PCT Pub. No.: WO2020/170910
PCT Pub. Date: Aug. 27, 2020

(65) Prior Publication Data

US 2022/0098695 A1 Mar. 31, 2022

(30) Foreign Application Priority Data

Feb. 18, 2019 (JP) ..... 2019-026505

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C21D 8/0226* (2013.01); *C21D 8/0236* (2013.01); *C22C 38/002* (2013.01); *C22C 38/02* (2013.01); *C22C 38/04* (2013.01); *C22C 38/06* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 9,546,413 | B2 | 1/2017 | Nozaki et al. | |
| 9,670,569 | B2 | 6/2017 | Nozaki et al. | |
| 10,378,077 | B2 | 8/2019 | Girina et al. | |
| 11,001,904 | B2 | 5/2021 | Girina et al. | |
| 11,124,853 | B2 | 9/2021 | Girina et al. | |
| 11,131,003 | B2 | 9/2021 | Girina et al. | |
| 2013/0133786 | A1* | 5/2013 | Matsuda | C23C 2/02 148/661 |
| 2014/0000765 | A1 | 1/2014 | Nozaki et al. | |
| 2014/0014236 | A1 | 1/2014 | Nozaki et al. | |
| 2015/0167133 | A1 | 6/2015 | Paul et al. | |
| 2021/0222267 | A1 | 7/2021 | Girina et al. | |

FOREIGN PATENT DOCUMENTS

| | | | |
|---|---|---|---|
| CN | 106661652 | A | 5/2017 |
| EP | 2 171 112 | A1 | 4/2010 |
| EP | 2 546 368 | A1 | 1/2013 |
| JP | 2011-184757 | A | 9/2011 |
| JP | 5408383 | B2 | 2/2014 |
| JP | 2015-151576 | A | 8/2015 |
| JP | 2017-53001 | A | 3/2017 |
| KR | 10-2012-0120440 | A | 11/2012 |
| KR | 10-2017-0131606 | A | 11/2017 |

OTHER PUBLICATIONS

International Search Report issued May 12, 2020 in PCT/JP2020/005370 filed Feb. 12, 2020.
Extended European Search Report issued Sep. 17, 2021 in corresponding European Patent Application No. 20760017.2, 8 pages.

* cited by examiner

*Primary Examiner* — Jophy S. Koshy
(74) *Attorney, Agent, or Firm* — Oblon, McClelland, Maier & Neustadt, L.L.P.

(57) ABSTRACT

Disclosed is a steel sheet including predetermined elements in each predetermined amount, with the balance consisting of iron and inevitable impurities, wherein a total area ratio of bainite, bainitic ferrite, martensite, residual austenite, and a martensite-austenite mixed structure is 95% or more and 100% or less, a total area ratio of ferrite and pearlite is less than 5%, an area ratio of the martensite-austenite mixed structure is 5% or more and 30% or less, an average section length of the martensite-austenite mixed structure is 0.32 μm or less, and a proportion of an area of a region in ferrite, bainitic ferrite, and martensite where no cementite is present to the total area of ferrite, bainitic ferrite, and martensite is 3.0% or more and 5.0% or less.

2 Claims, No Drawings

STEEL SHEET

CROSS-REFERENCE TO RELATED APPLICATIONS

The present application claims priority to Japanese Patent Application No. 2019-026505 filed on Feb. 18, 2019, the disclosure of which is incorporated herein by reference in its entirety.

TECHNICAL FIELD

The present disclosure relates to steel sheets, and more particularly to a steel sheet usable for various applications, including automotive parts.

BACKGROUND ART

Steel sheets used for manufacturing automotive parts are desired to be thinned in order to improve the fuel efficiency through weight reduction. To achieve both the thinning and the securing of the strength of parts, it is required to increase the strength of the steel sheets. Further, the steel sheets used for manufacturing automotive parts are desired to have high energy absorption capacity at the time of collision, in consideration of collision safety, and thus it is also required to increase the ductility of the steel sheets. In general, the improvement in the strength of the steel sheets results in reduced ductility, making it difficult to guarantee energy absorption at the time of collision. Therefore, in order to achieve high strength and high ductility, it is necessary to increase the ductility by improving TS×EL (elongation), in addition to increasing the strength by improving tensile strength (TS).

Furthermore, the steel sheets used for manufacturing automotive parts are required to have excellent formability for processing into parts with complex shapes, and in particular, they are required to have an excellent hole expansion ratio (A), which is an index of the local deformability.

For example, Patent Document 1 discloses a steel sheet in which the polar density of a specific crystal orientation in the sheet-thickness range of ⅝ to ⅜ is controlled to be within a predetermined range. The steel sheet is obtained through a hot rolling process by performing first hot rolling including one or more passes at rolling reduction ratio of 40% or more in a temperature range of 1,000° C. or higher and 1,200° C. or lower, performing large reduction rolling in a temperature of T1+30° C. or higher and T1+200° C. or lower, and restricting a rolling reduction ratio in a temperature range of $Ar_3$° C. or higher and lower than T1+30° C. The steel sheet is said to satisfy TS×EL>14,000.

Patent Document 2 discloses a steel sheet containing tempered martensite, bainite, and austenite, with the ferrite content restricted to 10% or less, and in which the grain boundaries of 80% or more of bainite grains of the bainite are in contact with both the tempered martensite and austenite. The steel sheet is said to have a strength of 1300 MPa or more and excellent formability.

Patent Document 3 discloses a steel sheet which is controlled so that the content of residual austenite is 10% or more, with a carbon content in the residual austenite being 0.85% or more, and that the ratio of the Mn content in the residual austenite to the average Mn content of the steel sheet is 1.1 or more. The steel sheet is obtained by subjecting a steel material to first annealing through holding the steel material in the temperature range of 300° C. to the $Ac_3$ point for 30 minutes or more after hot rolling, followed by cold rolling, then heating it to the $Ac_1$ point to 950° C., subsequently cooling it to 150 to 600° C., subjecting it to hot-dip galvanization, thereafter cooling it to 300° C. or lower, and finally tempering it in the temperature range of 100 to 600° C. This steel sheet is said to have a strength of 1,470 MPa or more and excellent deformability.

PRIOR ART DOCUMENT

Patent Document

Patent Document 1: JP 5408383 B
Patent Document 2: JP 2015-151576 A
Patent Document 3: JP 2017-053001 A

DISCLOSURE OF THE INVENTION

Problems to be Solved by the Invention

However, it is currently difficult to manufacture a steel sheet that achieves high strength and high ductility and has an excellent hole expansion property, despite extensive studies including the above-mentioned technology.

An embodiment of the present invention has been made in view of such a situation, and its object is to provide a steel sheet having excellent strength, ductility, and hole expansion property.

Means for Solving the Problems

A steel sheet of a first aspect of the present invention includes:

C: 0.35 to 0.60% by mass,
Si: 2.1 to 2.8% by mass,
Mn: 1.2 to 1.8% by mass,
P: 0.05% by mass or less,
S: 0.01% by mass or less, and
Al: 0.01 to 0.1% by mass, with the balance consisting of iron and inevitable impurities,
wherein a total area ratio of bainite, bainitic ferrite, martensite, residual austenite, and a martensite-austenite mixed structure is 95° or more and 100° or less,
a total area ratio of ferrite and pearlite is less than 5%,
an area ratio of the martensite-austenite mixed structure is 5% or more and 30% or less,
an average section length of the martensite-austenite mixed structure is 0.32 μm or less, and
a proportion of an area of a region in ferrite, bainitic ferrite, and martensite where no cementite is present to the total area of ferrite, bainitic ferrite, and martensite is 3.0% or more and 5.0% or less.

A steel sheet of a second aspect of the present invention according to the first aspect further includes one or more elements selected from the group consisting of:

V: 0.001 to 0.05% by mass,
Nb: 0.001 to 0.05% by mass,
Ti: 0.001 to 0.05% by mass,
Zr: 0.001 to 0.05% by mass, and
Hf: 0.001 to 0.05% by mass.

A steel sheet of a third aspect of the present invention according to the first or second aspect further includes one or more elements selected from the group consisting of:

Cr: 0.001 to 0.50% by mass,
Mo: 0.001 to 0.50% by mass,
Ni: 0.001 to 0.50% by mass,
Cu: 0.001 to 0.50% by mass, and
B: 0.0001 to 0.0050% by mass.

A steel sheet of a fourth aspect of the present invention according to any one of the first to third aspects further includes one or more elements selected from the group consisting of:

Ca: 0.0001 to 0.0010% by mass,

Mg: 0.0001 to 0.0010% by mass,

Li: 0.0001 to 0.0010% by mass, and

REM: 0.0001 to 0.0010% by mass.

Effects of the Invention

The embodiment of the present invention provides the steel sheet having excellent strength, ductility, and hole expansion property.

BEST MODE FOR CARRYING OUT THE INVENTION

The inventors of the present application have conducted intensive studies so as to solve the above-mentioned problems. As a result, they have found that a steel sheet having high tensile strength (TS) and high TS×EL and excellent hole expansion ratio (λ) can be obtained by applying appropriate heat treatment to a steel material which has been controlled to have a high C content and a high Si content but a low Mn content.

More specifically, the Si content is increased to 2.1% by mass or more so that a carbon in the steel material is less likely to precipitate as a carbide, but more likely to remain in the form of residual austenite. In order to promote the refinement of MA through the formation of bainitic ferrite while suppressing the formation of ferrite during cooling and to promote the formation of carbide-free regions through the agglomeration of carbides in martensite, the Mn content is reduced to 1.8% by mass or less. By controlling the Si content and the Mn content in this way, TS×EL and λ can be improved.

However, a steel material that has a high Si content and a low Mn content usually has a high $Ac_3$ point, which makes it difficult to transform the steel material into a single phase of austenite in a general annealing facility (with an upper limit of heating temperature being about 950° C.), and also makes it difficult to reduce the area ratio of ferrite and pearlite. Consequently, the desired tensile strength cannot be obtained. For this reason, in order to keep the area ratio of ferrite and pearlite low in such a steel material, it is effective to increase the C content, and thus the high tensile strength can be obtained. Furthermore, by increasing the C content, the effect of increasing the area ratio of residual austenite is obtained, and thus TS×EL can increase.

The details of the steel sheet according to an embodiment of the present invention will be described below.

1. Steel Structure

In the steel sheet according to the embodiment of the present invention,

- the total area ratio of bainite, bainitic ferrite, martensite, residual austenite, and a martensite-austenite mixed structure is 95% or more and 100% or less,
- the total area ratio of ferrite and pearlite is less than 5%,
- the area ratio of the martensite-austenite mixed structure is 5% or more and 30% or less,
- the average section length of the martensite-austenite mixed structure is 0.32 μm or less, and
- the proportion of the area of regions in ferrite, bainitic ferrite, and martensite where no cementite is present to the total area of ferrite, bainitic ferrite, and martensite is 3.0% or more and 5.0% or less.

The "area ratio" of the structure refers to an area ratio of this structure in the entire structures.

"Martensite" includes both "as-quenched martensite" and "tempered martensite", and thus is composed of only one or both of these structures.

Each configuration will be described in detail below.

(1) Total area ratio of bainite, bainitic ferrite, martensite, residual austenite, and martensite-austenite mixed structure: 95% or more and 100% or less Bainite, bainitic ferrite, martensite, residual austenite, and a martensite-austenite mixed structure (hereinafter sometimes referred to as "MA" (Martensite-Austenite)) are high-strength structures even among the structures of the steel material. Thus, in order to ensure the high strength, it is necessary for the steel material to mainly contain these structures. Therefore, the total area ratio of these structures is set at 95% or more and 100% or less. The total area ratio of these structures is preferably 97% or more, and more preferably 99% or more.

(2) Total area ratio of ferrite and pearlite:less than 5%

Since ferrite and pearlite have low strength, it is necessary to reduce the proportion of these structures in order to ensure the high strength of the steel material. In addition, if a large amount of low-strength structure such as ferrite or pearlite is present in the high-strength structure, this low-strength structure becomes a starting point of occurrence of a crack to accelerate fracture, thereby degrading the hole expansion ratio. Therefore, the total area ratio of ferrite and pearlite is set at less than 5%. The total area ratio of ferrite and pearlite is preferably 3% or less, more preferably 1% or less, and most preferably 0%.

(3) Area ratio of martensite-austenite mixed structure:5% or more and 30% or less In the martensite-austenite mixed structure (MA), the residual austenite undergoes a TRIP phenomenon, which is a process-induced transformation to martensite during processing such as press working, and thus it can obtain large elongation. Further, the formed martensite has high strength, which is effective in improving the strength of the steel sheet. Thus, increasing the proportion of MA is effective in improving the strength-ductility balance. Therefore, the area ratio of MA is set at 5% or more. The area ratio of MA is preferably 6% or more, and more preferably 8% or more.

Meanwhile, as the area ratio of MA increases, the interface of MA/matrix phase, which becomes the starting point of fracture, is enlarged, and thus cracking is promoted during deformation, resulting in degradation of the hole expansion ratio. Therefore, the area ratio of MA is set at 30% or less. The area ratio of MA is preferably 27% or less, and more preferably 25% or less.

(4) Average section length of martensite-austenite mixed structure: 0.32 μm or less The martensite-austenite mixed structure (MA) is a structure effective in increasing the strength and ductility. However, MA may become cracked when the deformation of the structure progresses, or strain may be concentrated between the MA and its surrounding structure, cracking the MA at or near the interface therebetween. Such cracking of MA adversely affects the hole expansion ratio, and particularly, its adverse effect is remarkably exhibited when increasing the strength of the steel sheet. In order to minimize the adverse effect of cracking of the MA, it is effective to refine the MA. By suppressing cracking of the MA, the hole expansion ratio can be improved. Therefore, the size of the MA, i.e., the average section length of the MA, is set at 0.32

μm or less. The average section length of the MA is preferably 0.30 μm or less, and more preferably 0.28 μm or less.

(5) Proportion of the area of regions in ferrite, bainitic ferrite, and martensite where no cementite is present to the total area of ferrite, bainitic ferrite, and martensite: 3.0% or more and 5.0% or less When the steel sheet is largely deformed, for example, in a hole expansion test, cracks may occur due to the concentration of strain on the surroundings of a hard structure such as MA. In this case, if a relatively soft and highly deformable structure is mixed in a part of the matrix phase in the surroundings of the MA, the strain is also applied to that structure, enabling the strain in the surroundings of the MA to be reduced. Ferrite is a typical soft structure, but ferrite is excessively soft and also has a relatively large structure. Thus, too much strain is concentrated on ferrite, thereby accelerating fracture at the interface between ferrite and its surrounding structure.

For this reason, the inventors have come up with the idea of introducing, in addition to ferrite, a relatively soft non-ferrite structure that can reduce the strain in the surroundings of the MA. In other words, the inventors have found that by appropriately controlling the bainitic transformation and tempering the martensite, it is possible to partially form regions with a low number density of cementite in the bainitic ferrite and martensite, which is effective in obtaining a structure with some degrees of high strength and deformability. That is, the proportion of the area of the regions in ferrite, bainitic ferrite, and martensite where no cementite is present (hereinafter sometimes referred to as a "cementite-free region") to the total area of ferrite, bainitic ferrite, and martensite is set at 3.0% or more (hereinafter this proportion being sometimes referred to as the "proportion of the cementite-free region"). Consequently, the steel sheet with excellent elongation and hole expansion ratio while having higher strength can be obtained. If the proportion of the cementite-free region becomes excessive, the strength of the steel sheet is reduced. Thus, the proportion of the cementite-free region is set at 5.0% or less.

The proportion of the cementite-free region is preferably 3.2% or more, and more preferably 3.5% or more, while it is preferably 4.8% or less, and more preferably 4.5% or less.

The steel sheet according to the embodiment of the present invention may contain structures other than ferrite, bainitic ferrite, pearlite, bainite, martensite, residual austenite, and MA. In one embodiment, the steel sheet according to the embodiment of the present invention does not contain any structures other than ferrite, bainitic ferrite, pearlite, bainite, martensite, residual austenite, and MA.

In the following, a description will be given on examples of evaluation methods of the area ratio of each steel structure, the section length of the martensite-austenite mixed structure, and the proportion of the cementite-free region.

(1) Measurement of Area Ratio of Steel Structure

A full-thickness section of the steel sheet perpendicular to the rolling direction is polished and corroded with nital to expose its structure, and then an area randomly selected in a region of the section at ¼ of the sheet thickness is observed with a scanning electron microscope (SEM) at a magnification of 1000 to 5000 times to obtain SEM images. The obtained SEM images are subjected to microstructural sorting as follows.

A monochromatic region of dark contrast in the SEM image is defined as ferrite; a region of layered dark and white contrast is defined as pearlite; and a region of white to light gray contrast with no fine grain-like contrast therein is defined as the martensite-austenite mixed structure. Other regions with complex patterns are defined as bainite, bainitic ferrite, martensite and residual austenite.

For each of the obtained SEM images, 11 or more lines are drawn in a randomly selected area at equal intervals, with the width of the interval being 1 to 10 μm, in each of the longitudinal and horizontal directions, thereby forming a mesh with at least 10×10 squares, and then the area ratio of each structure is determined by a point counting method. It is noted that the value determined as the area ratio can be directly used as a value of the volume ratio (% by volume).

(2) Measurement of Section Length of Martensite-Austenite Mixed Structure

A full-thickness section of the steel sheet perpendicular to the rolling direction is polished and corroded with nital to expose its structure, and then an area randomly selected in a region of the section at ¼ of the sheet thickness is observed with the SEM at a magnification of 1,000 to 5,000 times to obtain SEM images. For each of the obtained SEM images, a plurality of straight lines, the total length of which is 100 μm or more, are drawn in a randomly selected area. For each straight line, a section length where this straight line intersects the martensite-austenite mixed structure is measured.

A large martensite-austenite mixed structure tends to adversely affect the hole expansion ratio. Thus, if all section lengths including those of fine structures are evaluated and averaged, the adverse effect of the large martensite-austenite mixed structure on the hole expansion ratio becomes unclear. For this reason, the average value of the section lengths exceeding 0.1 μm among the section lengths measured by the above method is calculated, and defined as the average section length of the martensite-austenite mixed structure.

(3) Measurement of the proportion (the proportion of the cementite-free region) of the area of regions in ferrite, bainitic ferrite, and martensite where no cementite is present to the total area of ferrite, bainitic ferrite, and martensite A full-thickness section of the steel sheet perpendicular to the rolling direction is polished and corroded with nital to expose its structure, and then an area randomly selected in a region of the section at ¼ of the sheet thickness is observed with the SEM at a magnification of 5,000 times to obtain SEM images. The obtained SEM images are subjected to microstructural sorting as mentioned above. That is, a monochromatic region of dark contrast is defined as ferrite, and other regions with complex patterns except for ferrite, pearlite, and the martensite-austenite mixed structure are defined as bainite, bainitic ferrite, martensite, and residual austenite. Of the regions with the complex patterns, regions of dark contrast are defined as bainitic ferrite and martensite.

For each of the obtained SEM images, 31 or more of lines are drawn in a randomly selected area at intervals of 0.5 μm in each of the longitudinal and horizontal directions, thereby forming a mesh with at least 30×30 squares.

N is defined as the total number of intersections located on any one of ferrite, bainitic ferrite, and martensite that are sorted as mentioned above, among all the intersections on the mesh.

For the intersections located on any one of ferrite, bainitic ferrite and martensite, a circle with a radius of 0.1 μm is placed such that the center of the circle overlaps each intersection.

Then, n is defined as the number of intersections where no cementite is present within the circle with the radius of 0.1 μm.

The granular material shown with less contrast in the regions of ferrite, bainitic ferrite and martensite is defined as cementite.

A value (%) obtained by dividing the number n of intersections where no cementite is present within the circle with the radius of 0.1 μm by the total number N of intersections located on any one of ferrite, bainitic ferrite, and martensite is defined as the proportion of the cementite-free region.

2. Chemical Composition

The steel sheet according to the embodiment of the present invention includes: C: 0.35 to 0.60% by mass, Si: 2.1 to 2.8% by mass, Mn: 1.2 to 1.8% by mass, P: 0.05% by mass or less, S: 0.01% by mass or less, and Al: 0.01 to 0.1% by mass, with the balance consisting of iron and inevitable impurities.

Each element will be described in detail below.

(1) C: 0.35 to 0.60% by mass

C is a major element associated with the formation of residual austenite and which is essential to obtain the desired structure and to ensure properties such as high TS and TS×EL. To effectively exhibit such effects, the C content is set at 0.35% by mass or more. The C content is preferably 0.36% by mass or more, and more preferably 0.38% by mass or more. Meanwhile, if the C content is excessive, the size of the martensite-austenite mixed structure cannot be made finer even by devising a heat treatment, and the proportion of the cementite-free region cannot be increased, failing to improve the hole expansion ratio. Therefore, the C content is set at 0.60% by mass or less. The C content is preferably 0.50% by mass or less, and more preferably 0.45% by mass or less.

It is noted that since C is one of the constituent elements of cementite, when the C content is small, the cementite-free region may become large regardless of heat treatment conditions.

(2) Si: 2.1 to 2.8% by mass

Si acts to suppress the precipitation of cementite and to promote the formation of residual austenite. To effectively exhibit such effects, the Si content is set at 2.1% by mass or more. The Si content is preferably 2.2% by mass or more, and more preferably 2.3% by mass or more. Meanwhile, if the Si content is excessive, the size of the martensite-austenite mixed structure becomes coarse, degrading the hole expansion ratio. Therefore, the Si content is set at 2.8% by mass or less. The Si content is preferably 2.7% by mass or less, and more preferably 2.6% by mass or less.

(3) Mn: 1.2 to 1.8% by mass

An increase in Mn content contributes to suppression of the formation of ferrite and pearlite. Furthermore, a decrease in Mn content enhances the ease of migration of the martensite/austenite interface or bainite/austenite interface during reheating after supercooling, and also promotes the formation of new bainitic ferrite in the austenite. Thus, Mn contributes to the refinement of the martensite-austenite mixed structure. Since a region formed by the migration of the martensite/austenite interface or bainite/austenite interface, as well as new bainitic ferrite formed in the austenite tend not to include cementite therein, the formation of the cementite-free region is promoted.

In order to effectively exhibit the effect of addition of Mn mentioned above, it is necessary to control the Mn content within an appropriate range. To effectively exhibit the effect of suppressing the formation of ferrite and pearlite, the Mn content is set at 1.2% by mass or more. The Mn content is preferably 1.3% by mass or more, and more preferably 1.4% by mass or more. Meanwhile, if the Mn content is excessive, the ease of migration of the martensite/austenite interface or bainite/austenite interface during reheating is degraded, thereby coarsening the martensite-austenite mixed structure in the final structure. Further, since Mn inhibits the agglomeration of carbides in martensite, the proportion of the cementite-free region reduces, resulting in reduced hole expansion ratio. Therefore, the Mn content is set at 1.8% by mass or less. The Mn content is preferably 1.7% by mass or less, and more preferably 1.6% by mass or less.

(4) P: 0.05% by mass or less

P is inevitably present as an impurity element. If the P content exceeds 0.05% by mass, the EL and hole expansion ratio are degraded. Therefore, the P content is set at 0.05% by mass or less. The P content is preferably 0.03% by mass or less. The lower the P content, the more preferable it is, and the P content is most preferably 0% by mass, but due to restrictions in the manufacturing process and the like, the P content may exceed 0% by mass, and for example, about 0.001% by mass of P may remain in some cases.

(5) S: 0.01% by mass or less

S is inevitably present as an impurity element. If the S content exceeds 0.01% by mass, sulfide-based inclusions such as MnS are formed and become the starting point of cracking, degrading the hole expansion ratio. Therefore, the S content is set at 0.01% by mass or less. The S content is preferably 0.005% by mass or less. The lower the S content, the more preferable it is, and the S content is most preferably 0% by mass, but due to restrictions in the manufacturing process and the like, the S content may exceed 0% by mass, and for example, about 0.001% by mass of S may remain in some cases.

(6) Al: 0.01 to 0.1% by mass

Al acts as a deoxidizing element, and reduces the amount of oxygen in the molten steel, thereby decreasing the number density of inclusions and improving the basic quality of the steel material. To effectively exhibit such effects, the Al content is set at 0.01% by mass or more. The Al content is preferably 0.015% by mass or more, and more preferably 0.020% by mass or more. Meanwhile, if the Al content is excessive, the formation of ferrite is promoted, making it impossible to obtain the desired structure. Therefore, the Al content is set at 0.1% by mass or less. The Al content is preferably 0.08% by mass or less, and more preferably 0.06% by mass or less.

(7) Balance

The basic components are as mentioned above, and the balance consists of iron and inevitable impurities (for example, As, Sb, Sn, and the like). The inevitable impurities include elements brought in the steel material, depending on the circumstances including raw materials, source materials, manufacturing facilities, and the like. Elements such as N and O are also inevitably mixed into the steel material but considered as acceptable impurities if their contents are 100 ppm or less.

There are some elements, such as P and S, for example, which are inevitable impurities usually preferred in smaller amounts and whose composition ranges are separately specified as mentioned above. For this reason, when the term "inevitable impurities" constituting the balance as used herein refer to the concept excluding an element, whose composition range is separately specified.

Further, the steel sheet according to the embodiment of the present invention may contain the following randomly selected elements as appropriate, and the properties of the steel sheet can be improved depending on the contained elements.

(8) One or more elements selected from the group consisting of V: 0.001 to 0.05% by mass, Nb: 0.001 to 0.05% by mass, Ti: 0.001 to 0.05% by mass, Zr: 0.001 to 0.05% by mass, and Hf: 0.001 to 0.05% by mass V, Nb, Ti, Zr and Hf form carbides or carbonitrides in the steel, thereby contributing to the strengthening of the matrix phase. To obtain such effects, when selectively containing V, Nb, Ti, Zr and Hf, the content of each of V, Nb, Ti, Zr and Hf is preferably 0.001% by mass or more. Meanwhile, if the contents of V, Nb, Ti, Zr, and Hf are excessive, added carbon is consumed as carbides, whereby the area ratio of MA is reduced, thus degrading the elongation, and additionally, the formation of ferrite is promoted during annealing, resulting in excessive amounts of ferrite and pearlite, making it difficult to ensure the strength of the steel. Thus, when selectively containing V, Nb, Ti, Zr and Hf, the content of each of V, Nb, Ti, Zr and Hf is preferably 0.05% by mass or less.

(9) One or more elements selected from the group consisting of Cr: 0.001 to 0.50% by mass, Mo: 0.001 to 0.50% by mass, Ni: 0.001 to 0.50% by mass, Cu: 0.001 to 0.50% by mass, and B: 0.0001 to 0.0050% by mass Cr, Mo, Ni, Cu, and B enhance hardenability and inhibit the formation of ferrite and pearlite, making it easier to ensure the strength of the steel. To obtain such effects, when selectively containing Cr, Mo, Ni, Cu, and B, the content of each of Cr, Mo, Ni, and Cu is preferably 0.001% by mass or more, while the B content is preferably 0.0001% by mass or more. Meanwhile, if the contents of Cr, Mo, Ni, Cu and B are excessive, they exhibit effects similar to those of Mn, resulting in coarse MA, and the proportion of the cementite-free region becomes smaller, degrading the hole expansion ratio. For this reason, when selectively containing Cr, Mo, Ni, Cu, and B, the content of each of Cr, Mo, Ni, and Cu is preferably 0.50% by mass or less, while the B content is preferably 0.0050% by mass or less.

(10) One or more elements selected from the group consisting of Ca: 0.0001 to 0.0010% by mass, Mg: 0.0001 to 0.0010% by mass, Li: 0.0001 to 0.0010% by mass, and REM: 0.0001 to 0.0010% by mass Ca, Mg, Li, and REM do not affect the structure, but can contribute to the improvement in the hole expansion property because they refine inclusions such as sulfides that would cause cracking in the hole expansion test. To obtain such effects, when selectively containing Ca, Mg, Li, and REM, the content of each of Ca, Mg, Li, and REM is preferably 0.0001% by mass or more. Meanwhile, if the contents of Ca, Mg, Li, and REM are excessive, conversely, the inclusions become coarse, degrading the hole expansion property. For this reason, when selectively containing Ca, Mg, Li, and REM, the content of each of Ca, Mg, Li, and REM is preferably 0.0010% by mass or less.

3. Properties

As mentioned above, the steel sheet according to the embodiment of the invention has excellent strength, ductility, and hole expansion property, so that the steel sheet has high levels of the tensile strength (TS), the product (TS×EL) of TS and total elongation (EL), and the hole expansion ratio (A). These properties of the steel sheet according to the embodiment of the present invention will be described in detail below.

(1) Tensile strength (TS)

The steel sheet according to the embodiment of the present invention has a tensile strength (TS) of 1,470 MPa or more. If the TS is less than 1,470 MPa, the resistance to load of the steel sheet at the time of collision becomes lower.

(2) Product (TS×EL) of TS and total elongation (EL)

In the steel sheet according to the embodiment of the present invention, the product (TS×EL) of TS and total elongation (EL) is 22.5 GPa % or more. The steel sheet has TS×EL of 22.5 GPa % or more, and thus can obtain the high level of the strength-ductility balance that simultaneously achieves high strength and high ductility. TS×EL is preferably 25.0 GPa % or more.

TS and EL can be determined in accordance with JIS Z 2241:2011.

(3) Hole expansion ratio (λ)

The steel sheet according to the embodiment of the present invention has a hole expansion ratio (λ) of 25% or more. Thus, the steel sheet can obtain excellent processability, such as press formability.

A can be determined in accordance with JIS Z 2256:2010. A punching hole with a diameter of $d_0$ ($d_0$=10 mm) is made in a test piece, and then a punch with a tip angle of 60% is pushed into the punching hole. The diameter d of the punching hole at the time when a generated crack penetrates the test piece in the thickness direction is measured, and thus λ is obtained from the following equation (1).

$$\lambda(\%)=\{(d-d_0)/d_0\}\times 100 \quad (1)$$

4. Manufacturing Method

A manufacturing method of the steel sheet according to the embodiment of the present invention includes the step of: (1) preparing a rolled steel material having the chemical composition mentioned above; (2) austenitizing the rolled steel material by heating it to a temperature of the $Ac_3$ point or higher and the $Ac_3$ point+100° C. or lower; (3) after the austenitization, cooling the austenitized steel material at an average cooling rate of 10° C./sec or more to a cooling stop temperature of 130° C. or higher and lower than 225° C.; and (4) heating the steel material from the cooling stop temperature to a reheating temperature of 410 to 460° C., and holding it in a temperature range of 410 to 460° C. for 120 to 1,200 seconds.

Each step will be described in detail below.

(1) Step of Preparing Rolled Material

The rolled material to be subjected to a heat treatment is usually produced by hot rolling, followed by cold rolling. However, the preparation step is not limited to this process above, and either hot rolling or cold rolling may be performed to produce the rolled material. The conditions for the hot rolling and cold rolling are not particularly limited.

(2) Step of Austenitizing

The rolled steel material is transformed into a single phase of austenite by heating it to the temperature of the $Ac_3$ point or higher and the $Ac_3$ point+100° C. or lower. The rolled steel material may be held at this heating temperature for 1 to 1,800 seconds. By setting the heating temperature to the temperature of the $Ac_3$ point or higher and the $Ac_3$ point+100° C. or lower, the coarsening of crystal grains can be suppressed, thus decreasing the section length of MA. The heating temperature is preferably the $Ac_3$ point+10° C. or higher, and more preferably $Ac_3$ point+20° C. or higher. The heating temperature is preferably the $Ac_3$ point+90° C. or lower, and more preferably $Ac_3$ point+80° C. or lower. This is because the rolled steel material is completely transformed into austenite, thereby making it possible to suppress the formation of ferrite, and also to surely suppress the coarsening of crystal grains.

The heating during the austenitizing may be performed at a randomly selected heating rate, preferably at an average heating rate of 1° C./sec or more and 20° C./sec or less.

$Ac_3$ point can be calculated from the following equation (2).

$$Ac_3(^\circ\text{ C.})=910-203\times\sqrt{[C]}-15.2\times[Ni]+44.7\times[Si]-30\times[Mn]+700\times[P]+400\times[Al]-11\times[Cr]-20\times[Cu]+31.5\times[Mo]+400\times[Ti]+104\times[V] \quad (2)$$

where [ ] represents the content of each element in % by mass.

(3) Step of Cooling to Cooling Stop Temperature after the Austenitization

After the austenitization, the austenitized steel material is cooled at an average cooling rate of 10° C./sec or more to a cooling stop temperature of 130° C. or higher and lower than 225° C. This cooling can transform a part of the structure into bainite, bainitic ferrite and/or martensite, and can also adjust the amount of austenite which remains without being transformed into bainite, bainitic ferrite and/or martensite. Thus, the total area ratio of bainite, bainitic ferrite, martensite, residual austenite, and MA can be controlled within the desired range.

If the cooling rate is slower than 10° C./sec, more ferrite and/or pearlite are formed, and thus the total area ratio of ferrite and pearlite becomes extremely large. The cooling rate is preferably 20° C./sec or more.

If the cooling stop temperature is lower than 130° C., the area ratio of MA becomes extremely small. Meanwhile, if the cooling stop temperature is 225° C. or higher, the size of MA becomes coarse. In other words, the section length of MA becomes extremely large, and the cementite-free region becomes extremely large. The cooling stop temperature is preferably 135° C. or higher, and more preferably 140° C. or higher. The cooling stop temperature is preferably 220° C. or lower, and more preferably 210° C. or lower.

The steel material may be held at the cooling stop temperature. The preferred holding time for the holding can be 1 to 600 seconds. The longer holding time has little effect on the properties of the steel material, but the holding time exceeding 600 seconds reduces the productivity.

(4) Step of Heating from Cooling Stop Temperature to Reheating Temperature and Holding at the Reheating Temperature The steel material is heated from the cooling stop temperature to a reheating temperature of 410 to 460° C. The heating rate up to the reheating temperature is not particularly limited. After the reheating temperature is reached, it is necessary to hold the steel material at 410 to 460° C. for 120 to 1,200 seconds at a constant temperature or by gradually heating and/or cooling. By holding the steel material at this reheating temperature, the martensite/austenite interface or bainite/austenite interface can be migrated. Alternatively, the cementite-free region can be formed by forming new bainitic ferrite in the austenite. The shorter holding time at 410 to 460° C. makes the cementite-free region extremely small. In contrast, the longer holding time at 410 to 460° C. causes austenite to decompose into bainitic ferrite and cementite, whereby the total area ratio of the residual austenite and MA becomes extremely small. The holding time at 410 to 460° C. is preferably 150 seconds or more, and more preferably 200 seconds or more, while it is preferably 1,000 seconds or less, and more preferably 800 seconds or less.

If the reheating temperature is lower than 410° C., the cementite-free region becomes extremely small. If the reheating temperature is higher than 460° C., the area ratio of MA becomes extremely small. In addition, the proportion of the cementite-free region becomes extremely large. The reheating temperature is preferably 415° C. or higher, and more preferably 420° C. or higher. Further, the reheating temperature is preferably 450° C. or lower.

This reheating allows carbon in the martensite to be stripped out to thereby promote carbon enrichment in the surrounding austenite, making it possible to stabilize the austenite. This can increase the amount of residual austenite finally obtained, and increase the area ratio of residual austenite and/or the area ratio of MA. Furthermore, the above-mentioned reheating can form bainite and/or bainitic ferrite from untransformed austenite, can temper martensite, or can appropriately coarsen carbides. Thus, the area ratio of highly ductile bainite, bainitic ferrite and/or tempered martensite can be increased. If the reheating temperature is extremely low, the cementite-free region becomes extremely small. Meanwhile, if the reheating temperature is extremely high, the cementite-free region becomes extremely large, and the area ratio of MA becomes extremely small.

After the reheating, the steel material is cooled from the reheating temperature to the room temperature. The conditions for this cooling are not particularly limited, but the cooling rate from the reheating temperature to 200° C., at which the structure can change, is preferably 1° C./sec or more.

Through the heat treatment mentioned above, the steel sheet according to the embodiment of the present invention can be obtained.

Although the manufacturing method of the steel sheet according to the embodiment of the present invention has been mentioned above, there is a possibility that the steel sheet according to the embodiment of the present invention can be obtained by a manufacturing method different from that mentioned above through trial and error conducted by a person skilled in the art who understands the desired properties of the steel sheet according to the embodiment of the present invention.

EXAMPLES

The present invention will be described in more detail below with reference to Examples. The present invention is not limited by the following Examples, and may be implemented with appropriate changes to the extent that it may conform to the purposes mentioned above and below, and all of these changes are included in the technical scope of the present invention.

1. Sample Preparation

After casting materials having the chemical compositions listed in Table 1 were produced by vacuum melting, the cast materials were hot forged into steel sheets, and then hot rolled twice to obtain hot-rolled steel sheets having a sheet thickness of 4.0 mm. Table 1 shows the $Ac_3$ points determined from the chemical compositions using equation (2).

The hot-rolled sheets were pickled to remove surface scales and then cold rolled to have a thickness of 1.5 mm. The cold-rolled sheets were subjected to heat treatment, thereby obtaining samples. The heat treatment conditions are shown in Table 2. The cooling was performed at 30° C./sec from the heating temperature to the cooling stop temperature.

Numerical values underlined in Tables 1 to 3 indicate they are out of the scope of the embodiment of the present invention. However, it is noted that "-" is not underlined even if it is out of the scope of the present invention.

TABLE 1

| Steel type | Chemical composition (% by mass) Balance being iron and inevitable impurities C | Si | Mn | P | S | Al | $Ac_3$ point (° C.) |
|---|---|---|---|---|---|---|---|
| a | 0.4 | 2.5 | 1.5 | 0.01 | 0.001 | 0.04 | 896 |
| b | 0.4 | 2.5 | 2 | 0.01 | 0.001 | 0.04 | 877 |
| c | 0.3 | 1.5 | 2 | 0.01 | 0.001 | 0.04 | 856 |

TABLE 2

| No. | Steel type | Heat treatment conditions: Heating temperature (° C.) | Cooling stop temperature (° C.) | Reheating temperature (° C.) | Holding time (sec) at 410 to 460° C. |
|---|---|---|---|---|---|
| 1 | a | 900 | 125 | 450 | 300 |
| 2 | a | 900 | 125 | 500 | 300 |
| 3 | a | 900 | 150 | 400 | 300 |
| 4 | a | 900 | 150 | 450 | 300 |
| 5 | a | 900 | 150 | 500 | 300 |
| 6 | a | 900 | 200 | 400 | 300 |
| 7 | a | 900 | 200 | 425 | 300 |
| 8 | a | 900 | 200 | 450 | 300 |
| 9 | a | 900 | 250 | 400 | 300 |
| 10 | a | 900 | 150 | 425 | 100 |
| 11 | b | 900 | 200 | 450 | 300 |
| 12 | c | 900 | 200 | 400 | 300 |

2. Steel Structure

For each steel sheet obtained as mentioned above, the area ratio of the steel structure, the section length of the martensite-austenite mixed structure, and the proportion of the cementite-free region were evaluated in the manner mentioned in (1) to (3) below.

(1) Measurement of Area Ratio of Steel Structure

A full-thickness section of the steel sheet perpendicular to the rolling direction was polished and corroded with nital to expose its structure, and then one area randomly selected in a region of the section at ¼ of the sheet thickness was observed (field of view: 3600 $\mu m^2$) with the SEM at a magnification of 1,000 times to obtain an SEM image. The obtained SEM image was subjected to microstructural sorting as follows.

A monochromatic region of dark contrast in the SEM image was defined as ferrite; a region of layered dark and white contrast was defined as pearlite; and a region of white to light gray contrast with no fine grain-like contrast therein was defined as the martensite-austenite mixed structure. Other regions with complex patterns were defined as bainite, bainitic ferrite, martensite and residual austenite.

For the obtained SEM image, 11 or more lines were drawn in a randomly selected area at equal intervals, with the width of the interval being 1 to 10 μm, in each of the longitudinal and horizontal directions, thereby forming a mesh with at least 10×10 squares, and then the area ratio of each structure was determined by a point counting method.

(2) Measurement of Section Length of Martensite-Austenite Mixed Structure

A full-thickness section of the steel sheet perpendicular to the rolling direction was polished and corroded with nital to expose its structure, and then one area randomly selected in a region of the section at ¼ of the sheet thickness was observed with the SEM at a magnification of 5,000 times (field of view: 144 $\mu m^2$) to obtain an SEM image. For the obtained SEM image, a plurality of straight lines in the total length of 100 μm or more were drawn in a randomly selected area, and then for each straight line, a section length where each straight line intersects the martensite-austenite mixed structure was measured.

At that time, an average value of the section lengths exceeding 0.1 μm or more among the section lengths measured in the above method was calculated, and the calculated value was defined as an average section length of the martensite-austenite mixed structure.

(3) Measurement of proportion (proportion of the cementite-free region) of the area of regions in ferrite, bainitic ferrite, and martensite where no cementite is present to the total area of ferrite, bainitic ferrite, and martensite A full-thickness section of the steel sheet perpendicular to the rolling direction was polished and corroded with nital to expose its structure, and then one area randomly selected in a region of the section at ¼ of the sheet thickness was observed with the SEM at a magnification of 5,000 times (field of view: 3600 pmt) to obtain an SEM image. For the obtained SEM image, a monochromatic region of dark contrast was defined as ferrite, and other regions with complex patterns except for ferrite, pearlite, and the martensite-austenite mixed structure were defined as bainite, bainitic ferrite, martensite, and residual austenite. Of the regions with the complex patterns, regions of dark contrast were defined as bainitic ferrite and martensite.

For the obtained SEM image, 31 or more of straight lines were drawn in one randomly selected area at intervals of 0.5 μm in each of the longitudinal and horizontal directions, thereby forming a mesh with at least 30×30 squares.

N was defined as the total number of intersections located on any one of ferrite, bainitic ferrite, and martensite that were sorted as mentioned above, among all the intersections on the mesh.

For the intersections located on any one of ferrite, bainitic ferrite, and martensite, a circle with a radius of 0.1 μm was placed such that the center of the circle overlaps each intersection.

Then, n was defined as the number of intersections where no cementite was present within the circle with the radius of 0.1 μm.

The granular material shown with less contrast in the regions of ferrite, bainitic ferrite and martensite was defined as cementite.

A value (%) obtained by dividing the number n of intersections where no cementite was present within the circle with the radius of 0.1 μm by the total number N of intersections located on any one of ferrite, bainitic ferrite, and martensite was referred to as the proportion of the cementite-free region.

3. Mechanical Properties

The mechanical properties of each sample obtained as mentioned above were measured by tensile testing in accordance with JIS Z 2241:2011. The tensile testing was conducted by taking a JIS No. 5 test piece from the direction (C direction) perpendicular to the rolling direction, followed by measuring TS and EL, and then TS×EL was calculated.

(Hole Expansion Ratio)

For each sample obtained as mentioned above, a test piece with a size of 70 mm×70 mm was taken from the center of the sample in the sheet surface direction, and then the hole expansion ratio was determined in accordance with JIS Z 2256:2010. Specifically, a punching hole with a diameter of $d_0$ ($d_0$=10 mm) was made in the test piece, and then a punch with a tip angle of 60° was pushed into the punching hole. The diameter d of the punching hole at the time when a generated crack penetrated the test piece in the thickness direction was measured, and thus λ was determined from the following equation (1).

$$\lambda(\%)=\{(d-d_0)d_0\}\times 100 \quad (1)$$

The respective measurement results are shown in Table 3. Regarding the mechanical properties of the steel sheet, samples satisfying all of the following criteria were indicated by "Pass" as having passed the test: TS: 1,470 MPa or more, TS×EL: 22.5 GPa % or more, and A: 25% or more. Meanwhile, other samples were indicated by "Fail" as having failed the test.

In Table 3, "S" indicates bainite, bainitic ferrite, martensite, residual austenite, and a martensite-austenite mixed structure.

"F+P" indicates ferrite and pearlite.

"Number of coarse MA" indicates the number of Ma regions with the section length exceeding 0.1 μm.

Numerical values underlined therein indicate they are out of the scope of the embodiment of the present invention.

TABLE 3

| Steel No. | Steel type | Steel microstructure: Area ratio (%) S | F + P | MA | Others | Average section length of MA (μm) | Number of coarse MA | Proportion of cementite-free region (%) | Mechanical properties: TS (MPa) | El (%) | TS × EL (GPa %) | A (%) | Evaluation |
|---|---|---|---|---|---|---|---|---|---|---|---|---|---|
| 1 | a | 100 | 0 | 4.0 | 0 | 0.25 | 106 | 3.2% | 1544 | 13.9 | 21.5 | 32.3 | Fail |
| 2 | a | 100 | 0 | 0.5 | 0 | 0.24 | 9 | 6.3% | 1361 | 9.4 | 12.8 | 31.5 | Fail |
| 3 | a | 100 | 0 | 6.6 | 0 | 0.24 | 65 | 2.6% | 1590 | 13.9 | 22.1 | 18.2 | Fail |
| 4 | a | 100 | 0 | 5.8 | 0 | 0.24 | 83 | 3.1% | 1521 | 14.8 | 22.5 | 29.2 | Pass |
| 5 | a | 100 | 0 | 0.8 | 0 | 0.18 | 5 | 6.2% | 1324 | 12.1 | 16.0 | 32.1 | Fail |
| 6 | a | 100 | 0 | 12.6 | 0 | 0.29 | 212 | 2.8% | 1526 | 17.1 | 26.1 | 19.1 | Fail |
| 7 | a | 100 | 0 | 12.9 | 0 | 0.30 | 221 | 4.2% | 1514 | 17.9 | 27.1 | 26.1 | Pass |
| 8 | a | 100 | 0 | 6.3 | 0 | 0.27 | 152 | 4.9% | 1481 | 16.7 | 24.8 | 25.4 | Pass |
| 9 | a | 100 | 0 | 14.9 | 0 | 0.33 | 240 | 5.4% | 1416 | 20.3 | 28.8 | 22.9 | Fail |
| 10 | a | 100 | 0 | 5.3 | 0 | 0.22 | 143 | 1.5% | 1590 | 14.4 | 22.9 | 20.5 | Fail |
| 11 | b | 100 | 0 | 18.9 | 0 | 0.36 | 337 | 3.0% | 1526 | 21.4 | 32.6 | 18.5 | Fail |
| 12 | c | 100 | 0 | 2.3 | 0 | 0.35 | 125 | 5.1% | 1412 | 11.2 | 15.8 | 32.1 | Fail |

As shown in Table 3, steels Nos. 4, 7, and 8, which are inventive steels (those with "Pass" as evaluation results), are examples that satisfy all the requirements specified in the embodiment of the present invention, and it can be confirmed that all of their TS, TS×EL, and λ satisfy the acceptance criteria, which can produce steel sheets with excellent strength, ductility, and hole expansion property.

In contrast, steels Nos. 1 to 3, 5, 6, and 9 to 12, which are comparative steels (those with "Fail" as evaluation results), are comparative examples that do not satisfy the requirements specified in the embodiment of the present invention, resulting in degradation of at least one of TS, TS×EL, and λ.

The steel No. 1 has a low area ratio of MA because of a low cooling stop temperature, resulting in degraded TS×EL.

The steel No. 2 has a low area ratio of MA and a high proportion of the cementite-free region because of a low cooling stop temperature and a high reheating temperature, resulting in degraded TS and TS×EL.

Steels Nos. 3 and 6 have a low proportion of the cementite-free region because of a low reheating temperature, resulting in degraded λ, and further resulting in degraded TS×EL especially in the steel No. 3.

The steel No. 5 has a low area ratio of MA and a high proportion of the cementite-free region because of a high reheating temperature, resulting in degraded TS and TS×EL.

The steel No. 9 has a large average section length of MA because of a high cooling stop temperature, and is affected significantly by the high cooling stop temperature even though the reheating temperature is low, so that the proportion of the cementite-free region becomes high, resulting in degraded TS and λ.

The steel No. 10 has a low proportion of the cementite-free region because of a short holding time at the reheating temperature, resulting in degraded λ.

The steel No. 11 has a large average section length of MA because of the use of a steel material of the type b having a large Mn content, resulting in degraded λ.

The steel No. 12 has a low area ratio of MA, a large average section length of MA, and further a high proportion of the cementite-free region because of a low reheating temperature and the use of a steel material of the type c having small contents of C and Si but a large Mn content. This results in degraded TS and TS×EL in the steel No. 12. In the steel No. 12, it is considered that because of the small C content and the low area ratio of MA, the adverse effect of coarse MA on λ becomes small even when MA becomes coarse, resulting in high λ. Furthermore, in the steel No. 12, it is also considered that the proportion of the cementite-free region becomes high because of the small C content.

The disclosure of the present description includes the following aspects.

First aspect:

A steel sheet including:

C: 0.35 to 0.60% by mass,

Si: 2.1 to 2.8% by mass,

Mn: 1.2 to 1.8% by mass,

P: 0.05% by mass or less,

S: 0.01% by mass or less, and

Al: 0.01 to 0.1% by mass, with the balance consisting of iron and inevitable impurities, wherein a total area ratio of bainite, bainitic ferrite, martensite, residual austenite, and a martensite-austenite mixed structure is 95% or more and 100% or less, a total area ratio of ferrite and pearlite is less than 5%, an area ratio of the martensite-austenite mixed structure is 5% or more and 30% or less, an average section length of the martensite-austenite mixed structure is 0.32 μm or less, and a proportion of an area of a region in ferrite, bainitic ferrite, and martensite where no cementite is present to the total area of ferrite, bainitic ferrite, and martensite is 3.0% or more and 5.0% or less.

Second aspect:

The steel sheet according to the first aspect, further including one or more elements selected from the group consisting of:

V: 0.001 to 0.05% by mass,
Nb: 0.001 to 0.05% by mass,
Ti: 0.001 to 0.05% by mass,
Zr: 0.001 to 0.05% by mass, and
Hf: 0.001 to 0.05% by mass.

Third aspect:

The steel sheet according to the first or second aspect, further including one or more elements selected from the group consisting of:

Cr: 0.001 to 0.50% by mass,
Mo: 0.001 to 0.50% by mass,
Ni: 0.001 to 0.50% by mass,
Cu: 0.001 to 0.50% by mass, and
B: 0.0001 to 0.0050% by mass.

Fourth aspect:

The steel sheet according to any one of the first to third aspects, further including one or more elements selected from the group consisting of:

Ca: 0.0001 to 0.0010% by mass,
Mg: 0.0001 to 0.0010% by mass,
Li: 0.0001 to 0.0010% by mass, and
REM: 0.0001 to 0.0010% by mass.

The present application claims priority to Japanese Patent Application No. 2019-026505 filed on Feb. 18, 2019, the disclosure of which is incorporated herein by reference in its entirety.

The invention claimed is:

1. A steel sheet comprising:

C: 0.35 to 0.60% by mass,
Si: 2.1 to 2.8% by mass,
Mn: 1.2 to 1.8% by mass,
P: 0.05% by mass or less,
S: 0.01% by mass or less, and
Al: 0.01 to 0.1% by mass, with the balance consisting of iron and inevitable impurities, wherein a total area ratio of bainite, bainitic ferrite, martensite, residual austenite, and a martensite-austenite mixed structure is 95% or more and 100% or less, a total area ratio of ferrite and pearlite is less than 5%, an area ratio of the martensite-austenite mixed structure is 5% or more and 30% or less, an average section length of the martensite-austenite mixed structure is 0.32 μm or less, and a proportion of an area of a region in ferrite, bainitic ferrite, and martensite where no cementite is present to the total area of ferrite, bainitic ferrite, and martensite is 3.0% or more and 5.0% or less.

2. The steel sheet according to claim 1, which satisfies one or more of the following (a) to (c):

(a) further comprising one or more elements selected from the group consisting of:
V: 0.001 to 0.05% by mass,
Nb: 0.001 to 0.05% by mass,
Ti: 0.001 to 0.05% by mass,
Zr: 0.001 to 0.05% by mass, and
Hf: 0.001 to 0.05% by mass;

(b) further comprising one or more elements selected from the group consisting of:
Cr: 0.001 to 0.50% by mass,
Mo: 0.001 to 0.50% by mass,
Ni: 0.001 to 0.50% by mass,
Cu: 0.001 to 0.50% by mass, and
B: 0.0001 to 0.0050% by mass; and (c) further comprising one or more elements selected from the group consisting of:
Ca: 0.0001 to 0.0010% by mass,
Mg: 0.0001 to 0.0010% by mass,
Li: 0.0001 to 0.0010% by mass, and
REM: 0.0001 to 0.0010% by mass.

* * * * *